US008529038B2

(12) United States Patent
Leighton et al.

(10) Patent No.: US 8,529,038 B2
(45) Date of Patent: Sep. 10, 2013

(54) SYSTEM AND METHOD FOR PRESSURE CONTROL OF AN INK DELIVERY SYSTEM

(75) Inventors: Roger G. Leighton, Hilton, NY (US); David Peter Lomenzo, Pittsford, NY (US); Patrick James Walker, Rochester, NY (US); Mark A. Atwood, Rush, NY (US)

(73) Assignee: Xerox Corporation, Norwalk, CT (US)

( * ) Notice: Subject to any disclaimer, the term of this patent is extended or adjusted under 35 U.S.C. 154(b) by 200 days.

(21) Appl. No.: 13/212,871

(22) Filed: Aug. 18, 2011

(65) Prior Publication Data

US 2013/0044165 A1 Feb. 21, 2013

(51) Int. Cl.
*B41J 2/175* (2006.01)

(52) U.S. Cl.
USPC ..... 347/88

(58) Field of Classification Search
USPC ..... 347/88
See application file for complete search history.

(56) References Cited

U.S. PATENT DOCUMENTS

| | | | | |
|---|---|---|---|---|
| 4,455,923 | A | 6/1984 | Müller | |
| RE33,539 | E * | 2/1991 | Karpal | 222/482 |
| 5,464,121 | A | 11/1995 | Jones | |
| 5,489,925 | A * | 2/1996 | Brooks et al. | 347/6 |
| 5,889,543 | A | 3/1999 | Miyazawa et al. | |
| 7,475,971 | B2 | 1/2009 | Herbert et al. | |
| 7,789,657 | B2 * | 9/2010 | Buezis et al. | 431/12 |
| 2003/0122904 | A1 * | 7/2003 | Matsumoto | 347/85 |
| 2003/0132980 | A1 * | 7/2003 | Yamazaki et al. | 347/19 |
| 2004/0174417 | A1 * | 9/2004 | Kobayashi et al. | 347/85 |
| 2009/0009574 | A1 * | 1/2009 | Leighton | 347/88 |
| 2010/0013896 | A1 | 1/2010 | Ishizawa et al. | |
| 2010/0077855 | A1 | 4/2010 | McCracken et al. | |
| 2010/0283822 | A1 | 11/2010 | Arnold et al. | |
| 2011/0141212 | A1 | 6/2011 | Smith et al. | |

* cited by examiner

*Primary Examiner* — Matthew Luu
*Assistant Examiner* — Alexander D Shenderov
(74) *Attorney, Agent, or Firm* — Maginot, Moore & Beck, LLP

(57) ABSTRACT

A pressurized ink delivery system having two delivery reservoirs in an inkjet printer enables a control system to alternate between the two reservoirs for printhead supply without coupling pressurized air from a delivery reservoir to a low pressure source of ink. Each delivery reservoir includes a conduit having an orifice that enables the pressure within a delivery reservoir to exit the reservoir before the ink delivery reservoir is fluidly connected to the low pressure source of ink for refilling of the delivery reservoir. By dropping the high pressure reservoir to atmosphere and then switching the seal actuators for the two reservoirs, the spray of ink is avoided.

7 Claims, 4 Drawing Sheets

SYSTEM AND METHOD FOR PRESSURE CONTROL OF AN INK DELIVERY SYSTEM

TECHNICAL FIELD

This disclosure relates generally to printing devices having one or more print heads that eject liquid ink onto an image receiving member, and more particularly, to printing devices that use pressure to supply ink to the one or more printheads.

BACKGROUND

Phase-change ink printing systems include various imaging devices that offer many advantages over other types of document reproduction technologies, such as laser and aqueous inkjet approaches. These advantages often include higher document throughput (i.e., the number of documents reproduced over a unit of time), fewer mechanical components needed in the actual image transfer process, fewer consumables to replace, and sharper images.

A typical solid ink or phase-change ink imaging device includes an ink loader, which receives and stages solid ink for delivery to a melting device. The ink supply can be replenished by a user inserting more solid ink into the loader. The loader has separate loader channels, each of which supplies a different color of ink to a melting device. For example, four loader channels are provided in an imaging device that uses cyan, magenta, yellow, and black (CMYK) ink to form ink image images. Solid ink is supplied in a variety of forms that include blocks, sticks, pellets, and pastilles, for example.

Solid ink imaging devices melt the solid ink to a liquid phase for imaging operations. In a typical embodiment, a melting device heats the solid ink to a temperature at which the solid ink enters a liquid phase. The one or more printheads in an imaging device receive the liquid ink and eject liquid drops of the ink through a plurality of inkjets onto an image receiving member, such as paper, or an indirect receiver, such as a rotating drum or endless belt. Many printer embodiments maintain a supply of liquefied ink in an ink reservoir that is fluidly coupled to one or more printheads for printing onto the image receiving member.

In some printers, gravity urges ink in the reservoir to flow to the printheads. In other printers, a pumping system applies pressure to liquid ink in the reservoir to urge the ink to the printheads. Continuous feed printers form images on an elongated media web that moves through the printer at a high speed for high-volume production. These continuous feed printers often consume ink at a high rate and require a pressurized ink reservoir to maintain a uniform supply of ink to the printheads. In one type of continuous printer, two separate delivery reservoirs supply ink to a common set of printheads using an alternating operating technique. In the alternating operating technique, one of the two delivery reservoirs is connected to a low pressure reservoir to enable ink to flow from the low pressure reservoir to the connected delivery high pressure reservoir side while the other delivery reservoir is disconnected from the low-pressure reservoir and the high pressure reservoir side is pressurized to deliver ink to the printheads. When the level of ink in the pressurized delivery reservoir drops below a predetermined fluid level, the pressurized delivery reservoir is disconnected from the pressure source, a double-ended seal piston is toggled to enable ink to flow from the low pressure reservoir. The other ink delivery reservoir is disconnected from the low-pressure reservoir and pressurized to deliver ink to the printheads. In one implementation of the alternating process, each of the ink delivery reservoirs includes a piston. The two pistons are mechanically linked so that one piston seals one ink delivery reservoir from the low-pressure reservoir, while the other piston simultaneously opens the other ink delivery reservoir to receive ink from the low-pressure reservoir. The alternating arrangement of the two delivery ink reservoirs enables a substantially continuous supply of ink to the printheads during printing operations.

One challenge facing a pressurized reservoir system involves the depressurization of the ink delivery reservoirs. The challenge arises from the pressurization of an air pocket positioned over the ink held in the ink delivery reservoir. When the level of ink in the pressurized reservoir drops below the predetermined threshold and the ink delivery reservoir is placed in fluid communication with the low-pressure reservoir, the pressurized air exits the delivery reservoir and enters the low-pressure reservoir through the valve seat opening. This pressurized air exits through the valve seat opening to cause ink held in the low-pressure reservoir to splatter and aerosol some of the ink in the low-pressure reservoir. Ink droplets resulting from the splatter may escape the low-pressure reservoir through openings in the low-pressure ink reservoir. Some of the escaped ink may contaminate the air supply vents and cause premature failure by blocking the air flow in the vent line. Consequently, improvements to the operation of the pressurized ink delivery system to prevent ink contamination would be beneficial.

SUMMARY

In one embodiment, an ink delivery system in a phase change ink printer has been developed. The system includes a housing forming a first ink reservoir and a second ink reservoir, a first ink inlet formed in the housing to enable liquid ink to enter the first ink reservoir, a first ink outlet formed between the first ink reservoir and the second ink reservoir in the housing to enable liquid ink to move from the first ink reservoir to the second ink reservoir, a second ink outlet formed in the housing to fluidly couple the second ink reservoir to at least one printhead, a member positioned within the housing and configured to move between a first position and a second position, the member forming a seal with the second outlet opening to enable liquid ink to enter the second reservoir through the first ink outlet in the first position, and the member forming another seal with the first ink outlet to enable ink to exit the second ink reservoir through the second ink outlet in the second position, a conduit formed through the housing, the conduit having an inlet configured to receive pressurized air and an outlet in fluid communication with the second ink reservoir to enable pressurization of air in the second ink reservoir when the member is in the second position, and an orifice formed in the conduit, the orifice being configured to enable the pressurized air in the second ink reservoir to exit the second ink reservoir through the conduit when the member is in the second position.

In another embodiment, a method of operating an ink delivery system in a phase change ink printer has been developed. The method includes receiving liquid ink in a first ink reservoir, moving a member to a first position that enables the liquid ink in the first ink reservoir to exit the first ink reservoir through a first ink outlet and enter a second ink reservoir, moving the member to a second position that seals the first ink outlet and enables the ink in the second ink reservoir to exit the second ink reservoir through a second ink outlet that is fluidly coupled to at least one printhead, activating a source of pressurized air to supply pressurized air to the second ink reservoir through a conduit fluidly coupled to the second ink reservoir, deactivating the source of pressurized air to enable pressurized air in the second ink reservoir to exit the second ink reservoir through an orifice formed in the conduit, and moving the member from the second position to the first position to enable ink in the first ink reservoir to enter the second ink reservoir through the first ink outlet after deactivation of the source of pressurized air.

In another embodiment, an ink delivery system in a phase change ink printer has been developed. The system includes a housing forming a first ink reservoir, a second ink reservoir, and a third ink reservoir, a first ink inlet formed in the housing to enable liquid ink to enter the first ink reservoir, a first ink outlet formed between the first ink reservoir and the second ink reservoir to enable the liquid ink to move from the first ink reservoir to the second ink reservoir, a second ink outlet formed between the first ink reservoir and the third ink reservoir to enable the liquid ink to move from the first ink reservoir to the third ink reservoir, a third ink outlet formed in the housing to fluidly couple the second ink reservoir to at least one printhead, a fourth ink outlet formed in the housing to fluidly couple the third ink reservoir to the at least one printhead, a first member positioned within the housing and configured to move between a first position and a second position, the first member forming a seal with the third outlet opening to enable liquid ink to enter the second ink reservoir through the first ink outlet in the first position, and the first member forming another seal with the first ink outlet to enable ink to exit the second ink reservoir through the third ink outlet in the second position, a second member positioned within the housing and configured to move between a third position and a fourth position, the second member forming a seal with the fourth outlet opening to enable liquid ink to enter the third ink reservoir through the second ink outlet in the third position, and the second member forming another seal with the second ink outlet to enable ink to exit the second ink reservoir through the fourth ink outlet in the fourth position, a first conduit formed through the housing having a first inlet configured to receive pressurized air and a first outlet in fluid communication with the second ink reservoir to enable pressurization of air in the second ink reservoir when the first member is in the second position, a second conduit formed through the housing having a second inlet configured to receive pressurized air and a second outlet in fluid communication with the third ink reservoir to enable pressurization of air in the third ink reservoir when the second member is in the fourth position, a first orifice formed in the first conduit, the first orifice being configured to enable pressurized air in the second ink reservoir to exit the second ink reservoir through the first conduit when the first member is in the second position, and a second orifice formed in the second conduit, the second orifice being configured to enable pressurized air in the third ink reservoir to exit the third ink reservoir through the second conduit when the second member is in the fourth position.

BRIEF DESCRIPTION OF THE DRAWINGS

The foregoing aspects and other features of an ink delivery system that controls a pressure applied to a pressurized ink reservoir are explained in the following description, taken in connection with the accompanying drawings.

DETAILED DESCRIPTION

Figure 1:
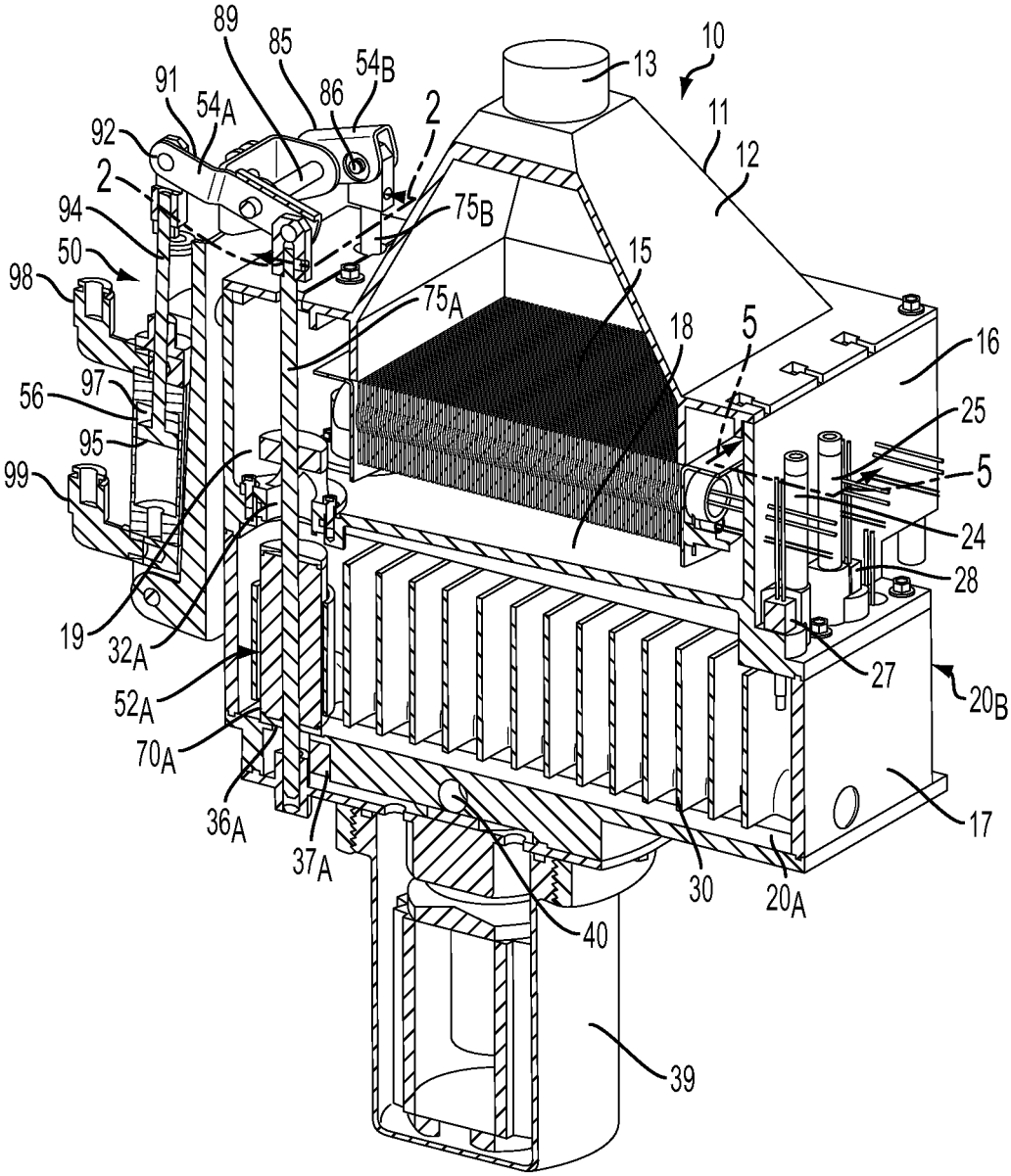
FIG. 1 is a perspective partial cut-away view of an ink delivery system according to the present disclosure.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multifunction machine, or the like.

Referring to FIG. 1, an ink delivery apparatus 10 includes a melting apparatus 11 configured to liquefy solid ink for delivery to one or more printheads. In one embodiment, the solid ink is in pellet form, although solid ink sticks, blocks, or pastilles may be used in other embodiments. The melting apparatus 11 includes a pellet distributor 12 that receives solid ink pellets through an intake tube 13. The pellets may be obtained from an ink supply, such as a drum, by gravity feed or by a pressurized feed. The flow of solid ink pellets to the pellet distributor 12 may be regulated in a suitable manner to achieve optimum performance of the melting apparatus.

The melting apparatus 11 further includes a high efficiency heater 15. The heater 15 generally includes a plurality of heated fins onto which the solid ink pellets are dispensed. The pellets are continuously melted by the fins and the melted ink drips between the fins into a low pressure reservoir 18. In the illustrated embodiment, the low pressure reservoir is formed within a housing 16 that includes a slanted floor positioned directly beneath the heater 15. The slanted floor of the low pressure reservoir is configured to direct the melted ink received through heater 15 toward a collection region 19 where the melted ink can be conveyed to the high pressure reservoirs described below. The reservoir 18 is identified as "low pressure" because the reservoir is generally maintained at ambient pressure within the printing machine, or at a pressure less than the high pressurized reservoirs described herein. Alternatively, the melting apparatus 11 may be slightly pressurized or maintained at atmospheric pressure.

In accordance with one feature, the ink delivery apparatus is provided with multiple high pressure reservoirs that are used to provide a continuous uninterrupted supply of melted ink to one or more printheads. In one embodiment, two such reservoirs are provided, namely reservoirs $\mathbf{20}_A$ and $\mathbf{20}_B$, which are formed within a housing 17. In one embodiment, the housing 17 is integral with the housing 16, while in other embodiments the housing 17 is separate from the housing 16, which forms the low pressure reservoir 18. For purposes of the present disclosure, the high pressure reservoirs $\mathbf{20}_A$, $\mathbf{20}_B$ may be referred to as the first and second reservoirs or as reservoir A and reservoir B, respectively. Like components of the reservoirs may also be designated with a subscript A or B to refer to the associated high pressure reservoir.

The reservoirs $\mathbf{20}_A$, $\mathbf{20}_B$ are connected by pressure inputs 24, 25 to a pressure source, which may be an air pressure supply that is controlled and regulated by a controller (not shown) of the printing machine. The pressure in the reservoirs $\mathbf{20}_A$, $\mathbf{20}_B$ is sufficient to feed high pressure inkjets of the one or more printheads, as is known in the art. As explained in more detail herein, the high pressure reservoirs $\mathbf{20}_A$, $\mathbf{20}_B$ are periodically pressurized as the ink supply is discharged to the printhead(s) and de-pressurized as a new supply of molten ink is introduced into the reservoir. Each high pressure reservoir $\mathbf{20}_A$, $\mathbf{20}_B$ is provided with a corresponding ink level sensor 27, 28, which determine the volume or level of ink remaining in the reservoir. The sensors 27, 28 may be of any construction suitable for providing a signal indicative of the ink level and/or indicative of the ink level dropping to a threshold value. The sensor may be a mechanical float-type sensor or may be an electrical probe assembly. Each high pressure reservoir $\mathbf{20}_A$, $\mathbf{20}_B$ includes a heating element 30 that is operable to maintain the molten ink at a temperature above the solidification temperature of the ink. As shown in FIG. 1, the heating element 30 may include a plurality of spaced-apart heated fins to ensure a uniform heat distribution throughout the reservoir.

Figure 2:
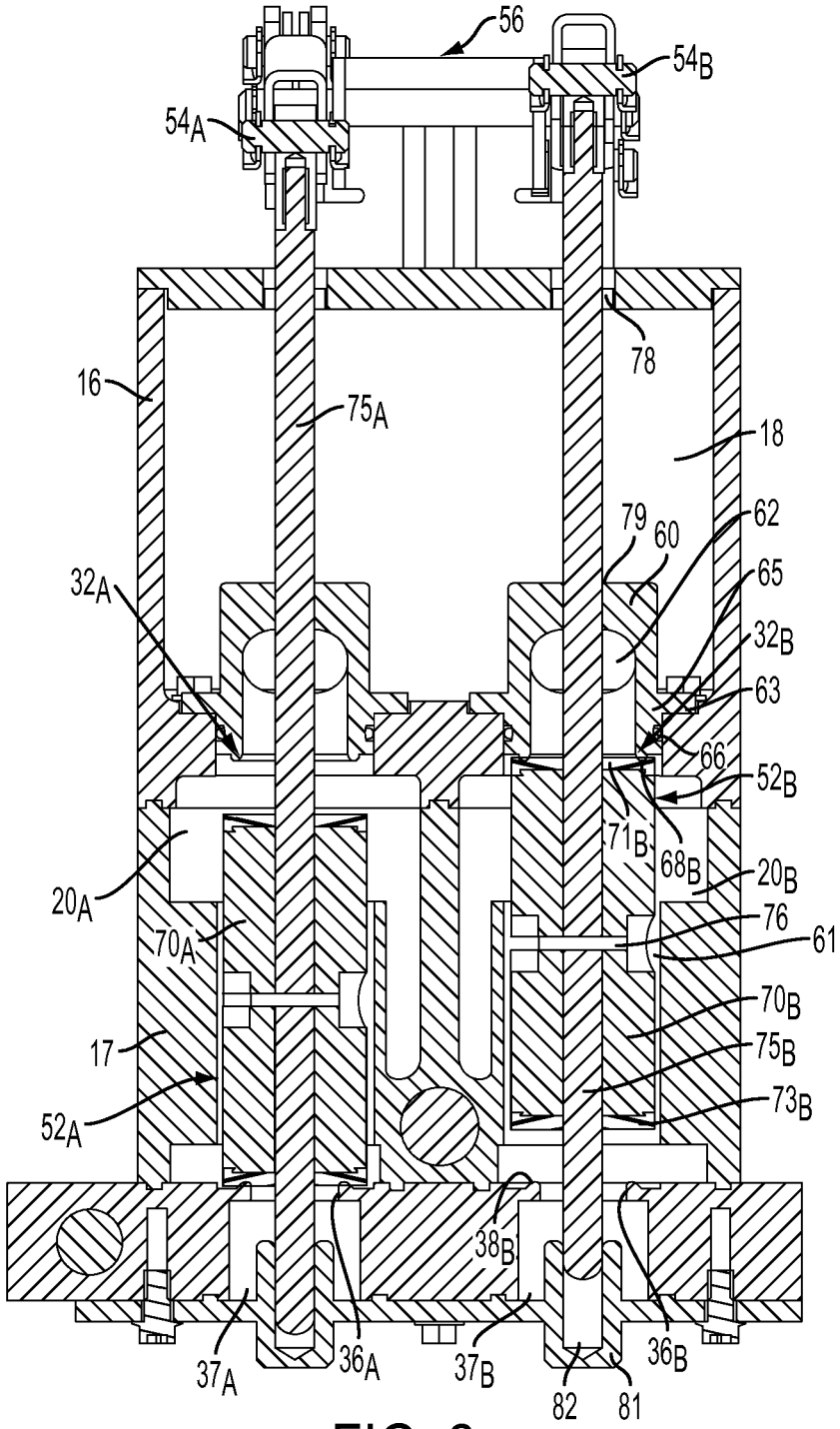
FIG. 2 is a side cross-sectional view of the ink delivery system shown in FIG. 1.

As shown in FIGS. 1-2, liquid ink is supplied from the low pressure reservoir 18 to each of the high pressure reservoirs $\mathbf{20}_A$, $\mathbf{20}_B$ through an inlet opening $\mathbf{32}_A$, $\mathbf{32}_B$. Each reservoir also includes an outlet opening $\mathbf{36}_A$, $\mathbf{36}_B$ that communicates with outlet channels $\mathbf{37}_A$, $\mathbf{37}_B$ respectively. Each outlet channel $\mathbf{37}_A$, $\mathbf{37}_B$ is in fluid communication with at least one printhead and may incorporate a filter element 39 and a molten ink outlet 40 that feeds an outlet manifold (not shown).

In operation, pressurized liquid ink is forced from the outlet channels $\mathbf{37}_A$, $\mathbf{37}_B$, through the filter element 39 and outlet 40 to an array of tubing (not shown), which is coupled to the printhead(s). The pressure in the outlet channel $\mathbf{37}_A$, $\mathbf{37}_B$ is produced by pressure within the high pressure reservoir $\mathbf{20}_A$, $\mathbf{20}_B$ that is currently pressurized. The ink delivery apparatus 10 disclosed herein provides a mechanism for alternately fluidly coupling one of the high pressure reservoirs to the ink outlet 40 to discharge molten ink to the printhead(s) while the other high pressure reservoir is fluidly coupled to the low pressure reservoir 18 to be re-filled with liquid ink. The apparatus 10 thus comprises an ink delivery control mechanism 50 that includes valve assemblies $\mathbf{52}_A$, $\mathbf{52}_B$, rocker assemblies $\mathbf{54}_A$, $\mathbf{54}_B$, and an actuator assembly 56.

For the purposes of illustration, the valve assembly $\mathbf{52}_B$ is described with the understanding that the valve assembly $\mathbf{52}_A$ is substantially identically configured. The valve assembly $\mathbf{52}_B$ includes a valve seat body 60 disposed at or over the inlet opening $\mathbf{32}_B$. The valve seat body 60 defines one or more flow openings 62 that communicate between the low pressure reservoir 18 and the inlet opening $\mathbf{32}_B$. The valve seat body 60 is provided with a mounting flange 63 in one embodiment that mates the body with the housing 17 defining the reservoir. The valve seat body 60 further includes a sealing hub 65 projecting from the mounting flange and configured to fit snugly within the inlet opening $\mathbf{32}_B$. The sealing hub 65 includes a sealing element 66, such as an O-ring or flat rubber face seal washer, between the hub 65 and the housing 17. The sealing hub 65 defines a sealing face $\mathbf{68}_B$ facing a seal member $\mathbf{70}_B$, as illustrated in FIG. 2.

The seal member $\mathbf{70}_B$ is disposed for translation within a chamber 61 aligned between the inlet opening $\mathbf{32}_B$ and the outlet opening $\mathbf{36}_B$. The chamber 61 is partially defined by the housing 17 in the high pressure reservoir $\mathbf{20}_B$ in one embodiment and is defined by a number of walls that help align and guide the seal body $\mathbf{70}_B$ in other embodiments. In the latter case, the walls are configured to ensure a constant supply of molten ink to the outlet opening $\mathbf{36}_B$ and sized to achieve an optimal flow rate. Seal members $\mathbf{70}_A$, $\mathbf{70}_B$ forming part of the respective valve assembly $\mathbf{52}_A$, $\mathbf{52}_B$ are substantially identical in construction, both bodies being configured to translate between an uppermost position sealing the inlet opening $\mathbf{32}_A$, $\mathbf{32}_B$, and a lowermost position sealing the corresponding outlet opening $\mathbf{36}_A$, $\mathbf{36}_B$. As shown in FIG. 2, the seal members $\mathbf{70}_A$, $\mathbf{70}_B$ are arranged such that when seal member $\mathbf{70}_B$ seals the inlet opening $\mathbf{32}_B$, the other seal member $\mathbf{70}_A$ seals the outlet opening $\mathbf{36}_A$. The seal members $\mathbf{70}_A$, $\mathbf{70}_B$ are configured to alternate positions, such that one seal member seals the corresponding outlet opening while the other seal member seals the corresponding inlet opening.

The seal member $\mathbf{70}_B$ includes an upper seal $\mathbf{71}_B$ and a lower seal $\mathbf{73}_B$. The upper seal is configured for sealed engagement with the sealing face $\mathbf{68}_B$ of the valve seat body 60 described above. The seal member $\mathbf{70}_B$ in FIG. 2 is shown in sealed contact or engagement with the sealing face $\mathbf{68}_B$—i.e., with the seal body in its uppermost position. One or both of the upper seal $\mathbf{71}_B$ and sealing face $\mathbf{68}_B$ may incorporate a compressible element and/or a recessed face operable to ensure a fluid and pressure tight seal with the seal body. In addition, the seal member $\mathbf{70}_B$ and/or the upper seal $\mathbf{68}_B$ may be configured for an enhanced fluid seal when pressure is applied behind the seal, such as when the high pressure reservoir $\mathbf{20}_B$ is pressurized to discharge molten ink to the printhead(s). The seal member $\mathbf{70}_B$ is movable to a position for sealing contact or engagement with the sealing face $\mathbf{38}_B$ at the outlet opening $\mathbf{36}_B$. Thus, the seal body includes a lower seal $\mathbf{73}_B$ that is configured to achieve a fluid-tight seal with the sealing face $\mathbf{38}_A$. In FIG. 2, seal member $\mathbf{70}_A$ is shown in sealed contact with the corresponding outlet opening $\mathbf{36}_A$.

The length of the seal members $\mathbf{70}_A$, $\mathbf{70}_B$ are less than the distance between the opposed inlet $\mathbf{32}_A$, $\mathbf{32}_B$ and outlet openings $\mathbf{36}_A$, $\mathbf{36}_B$ in each high pressure reservoir $\mathbf{20}_A$, $\mathbf{20}_B$. The length of the seal members $\mathbf{70}_A$, $\mathbf{70}_B$ are calibrated such that when the seal member is sealing one opening (such as inlet opening $\mathbf{32}_B$) the member does not impede ink flow through opposite opening (such as outlet opening $\mathbf{36}_B$). At the same time, the travel distance of the seal members $\mathbf{70}_A$, $\mathbf{70}_B$ between the first position, sealing the outlet opening, and the second position, sealing the inlet opening, is preferably limited so that the time delay between unsealing one opening and sealing the opposite opening is minimized. In one specific embodiment, the length of the seal members $\mathbf{70}_A$, $\mathbf{70}_B$ are about 80-90% of the distance between the inlet and outlet openings in a given high pressure reservoir.

In order to translate the seal members $\mathbf{70}_A$, $\mathbf{70}_B$, each valve assembly $\mathbf{52}_A$, $\mathbf{52}_B$ is driven by a corresponding rocker assembly $M_A$, $M_B$. Rocker assembly $M_B$ includes a control rod $\mathbf{75}_B$ that extends downward through the housings 16, 17, and the seal body $\mathbf{70}_B$. The control rod $\mathbf{75}_B$ is affixed to the seal member $\mathbf{70}_B$ by an attachment pin 76 extending transversely through the rod $\mathbf{75}_B$ and seal member $\mathbf{70}_B$, as depicted in FIG. 2. In the illustrated embodiment, the control rod $\mathbf{75}_B$ is sized to extend through the height of both the low pressure 18 and high pressure $\mathbf{20}_B$ reservoirs. The rod $\mathbf{75}_B$ thus passes through a bore 78 entering the low pressure reservoir, through a rod bore 79 in the valve seat body 60 and ultimately into a receptacle 82 of rod support cup 81 at the base of the high pressure reservoir $\mathbf{20}_B$ and reservoir housing 17. Alignment of the control rod $\mathbf{75}_B$ is maintained by the bore 78, the rod bore 79, and the rod support cup 81 as the rod $\mathbf{75}_B$ moves up and down between the two sealing positions.

As shown in FIG. 1, the control rod $\mathbf{75}_B$ is coupled to a clevis 85 by a pivot pin 86. The clevis 85 pivots on an axle 89 supported on the ink delivery apparatus 10. The clevis 85 includes a link arm 91 that is connected to an actuator rod 94 by a pivot pin 92. The actuator rod 94 may be connected to a piston 95 of a pressure cylinder 97. The cylinder 97 is a hydraulic cylinder, and most preferably a pneumatic cylinder to make use of the pneumatics within many solid ink printing machines. The pressure cylinder 97 is provided with inlet/ outlet openings 98, 99 at opposite ends of the cylinder, and more particularly on opposite sides of the piston 95. The pressure cylinder 97 is thus configured to drive the piston 95 upward or downward depending upon whether pressurized gas, such as air, is introduced through the lower opening 99 or upper opening 98.

As the piston 95 is driven upward by air pressure through inlet 99, the actuator rod 94 travels upward to pivot the link arm 91 clockwise about the axle 89. The clockwise rotation of the link arm 91 drives the control rod $\mathbf{75}_A$ and seal member $\mathbf{70}_A$ downward to the position shown in FIG. 3. In this position the lower seal $\mathbf{73}_A$ is sealed against the sealing face $\mathbf{38}_A$ about the outlet opening $\mathbf{36}_A$. At the same time, the clevis 85 is pivoted counter-clockwise around the axle 89 as the pivot link arm 91 pivots clockwise, causing the control rod $\mathbf{75}_B$ and seal member $\mathbf{70}_B$ to move upwardly causing upper seal $\mathbf{71}_B$ to seal with sealing face $\mathbf{68}_B$, as shown in FIG. 2. Conversely, when air pressure is released through air inlet 99 and introduced through inlet 98 at the top of pressure cylinder 97, the piston 95 is driven downward, pulling the actuator rod 94 down. This movement pivots the link arm 91 counter-clockwise and the clevis 85 clockwise about the axle 89. Control rod $\mathbf{75}_A$ and seal member $\mathbf{70}_A$ are pulled upwardly until the upper seal $\mathbf{71}_A$ engages the sealing face $\mathbf{68}_A$, as shown in FIG. 4, while control rod $\mathbf{75}_B$ and seal member $\mathbf{70}_B$ are driven downwardly, sealing lower seal $\mathbf{73}_B$ with the sealing face $\mathbf{38}_B$.

In lieu of providing pressurized air alternately to the two inlets 98, 99, the piston 95 may be spring-biased to one position or the other (for instance biased upwardly) and a single inlet, such as inlet 98, can be alternately pressurized to act against the spring bias or released to allow the piston to return under spring-bias. As a further alternative, the air cylinder can be replaced by other actuators such as a cam assembly and stepper motor configured to drive the rocker arm into the two positions shown in FIGS. 3 and 4.

The embodiment of FIG. 1 includes one actuating assembly 56 configured to operate both rocker assemblies $\mathbf{54}_A$, $\mathbf{54}_B$ and both valve assemblies $\mathbf{52}_A$, $\mathbf{52}_B$. Alternatively, the system may include a separate actuating assembly to operate each rocker and valve assembly.

Figure 3:
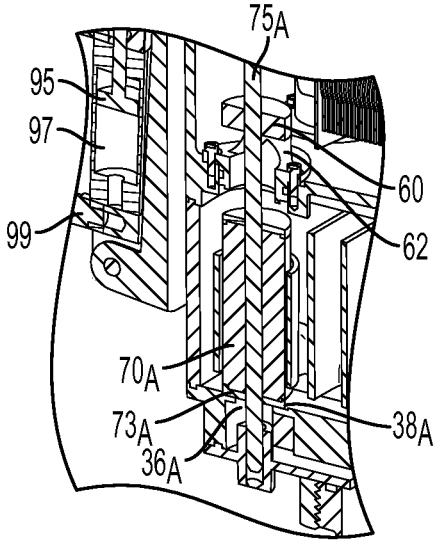
FIG. 3 is an enlarged view of components of the ink delivery system shown in FIG. 1, with the components in a first state.
Figure 4:
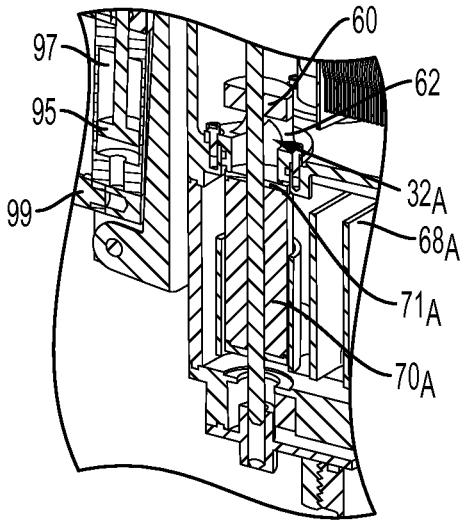
FIG. 4 is an enlarged view of components of the ink delivery system shown in FIG. 1, with the components in a second state.

In the position shown in FIG. 3, the outlet opening $\mathbf{36}_A$ from the high pressure reservoir $\mathbf{20}_A$ is sealed by the lower seal $\mathbf{73}_A$ while at the same time the inlet opening $\mathbf{32}_A$ is open. In this position, the high pressure reservoir $\mathbf{20}_A$ can be filled by ink that has been previously melted in the low pressure reservoir 18. At the same time, pressure in the high pressure reservoir $\mathbf{20}_A$ is vented through pressure input 24. The molten ink in the low pressure reservoir flows by gravity through the inlet opening $\mathbf{32}_A$ until the high pressure reservoir $\mathbf{20}_A$ is filled or until the molten ink in the low pressure reservoir 18 is depleted.

While the high pressure reservoir $\mathbf{20}_A$ is being filled, the other high pressure reservoir $\mathbf{20}_B$ is discharging the ink contents of the reservoir $\mathbf{20}_B$ under pressure. The internal level of the ink inside the reservoir is monitored by the low level sensor 28 to prevent emptying the contents and driving air into the system. The high pressure reservoir $\mathbf{20}_B$ thus has the seal member $\mathbf{70}_B$ in the position shown in FIG. 2 in which the upper seal $\mathbf{71}_B$ is sealed against the sealing face $\mathbf{68}_B$ to close off the inlet opening $\mathbf{32}_B$. When the seal member $\mathbf{70}_B$ is in its uppermost position, the outlet opening $\mathbf{36}_B$ is unimpeded. The pressure input 25 for the second high pressure reservoir $\mathbf{20}_B$ is activated to pressurize the reservoir and supply the molten ink under pressure to the printhead(s). The low level sensor 28 continuously monitors the ink level in the reservoir $\mathbf{20}_B$ and generates a low level signal when the ink level drops to the threshold value. This low level signal initiates a switch of active reservoir from the reservoir $\mathbf{20}_B$ to the other reservoir $\mathbf{20}_A$, which by this time has filled with molten ink.

Figure 5:
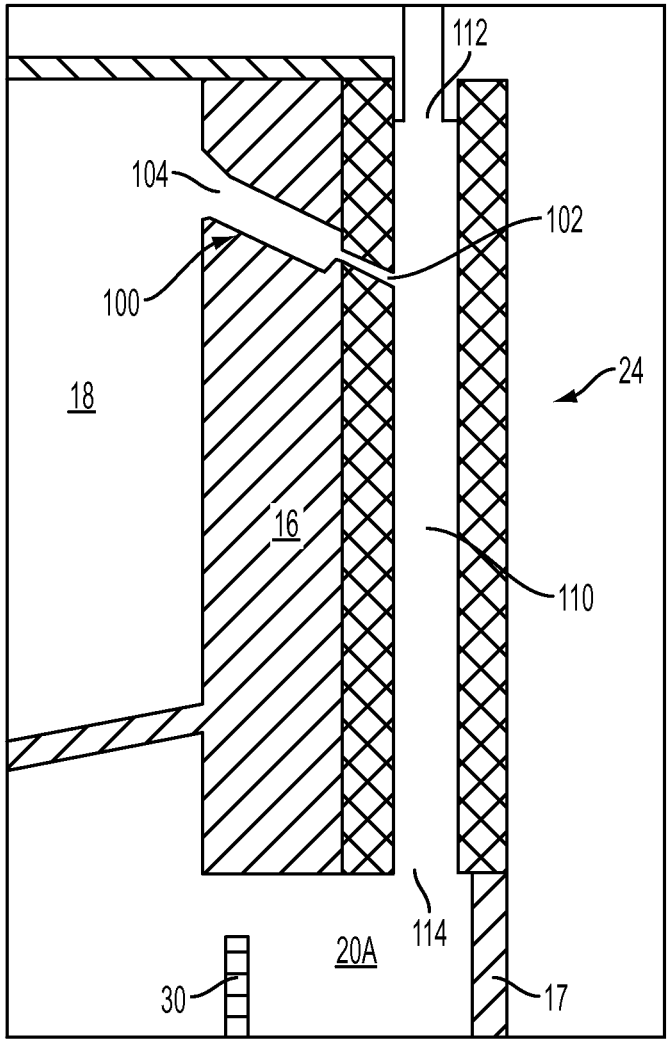
FIG. 5 is a partial cutaway of a pressure input and orifice of the ink delivery system shown in FIG. 1, cut along line 5-5 of FIG. 1.

FIG. 5 shows a partial cutaway view of pressure input 24. The pressure input 24 includes a conduit 110, having an inlet 112 and an outlet 114. The inlet 112 receives pressurized air from the pressure source. The pressurized air exits the conduit 110 through the outlet 114, where the air enters high pressure reservoir $\mathbf{20}_A$. An orifice 100 is bored through the conduit 110 and housing 16 to fluidly connect the low pressure reservoir 18 with the conduit 110 and high pressure reservoir $\mathbf{20}_A$. The orifice 100 has a precision inlet 102, which for one configuration is 0.028 inches in diameter. The size of the precision inlet 102 may be larger or smaller in other configurations, depending on the desired airflow through the orifice 100. The orifice 100 also includes an outlet 104, which discharges air into the low pressure reservoir 18. The orifice outlet 104 of the illustrated embodiment is larger than the precision inlet 102, although in other embodiments the outlet 104 is substantially equal to the size of the precision inlet 102. Pressure input 25 is configured substantially identical to pressure input 24, including a second conduit having an inlet, an outlet, and an orifice, which includes a second precision inlet.

The ink delivery control mechanism 50 disclosed herein provides a constant source of pressurized molten ink to be delivered to the printhead(s) by periodically switching between high pressure reservoirs $\mathbf{20}_A$, $\mathbf{20}_B$ feeding the molten ink. When one reservoir is "active" or "on-line"—i.e., supplying ink to the printhead(s)—the other reservoir can be re-filled from the low pressure reservoir. Once the ink in the active high pressure reservoir is at or near depletion, the control mechanism 50 can automatically open the other reservoir which has been filled with molten ink during its "inactive" or "off-line" state. The volumes in the chambers are sized so that the amount of ink buffered in both sides is sufficient to provide ink flow to meet the overall demand at maximum coverage on the substrate.

When the system switches ink supply to the printheads from high pressure reservoir $\mathbf{20}_A$ to high pressure reservoir $\mathbf{20}_B$, the pressure source of pressure input 24 ceases providing pressurized air. The pressure in high pressure reservoir $\mathbf{20}_A$ decreases according to a known pressure decay curve as the air escapes from the high pressure reservoir $\mathbf{20}_A$ through the orifice 100 and into the low pressure reservoir 18. In one embodiment, the seal member $\mathbf{70}_A$ remains in a sealing position with inlet opening $\mathbf{32}_A$ for approximately six seconds after the pressure input ceases, to allow the pressure in the high pressure reservoir $\mathbf{20}_A$ to substantially equalize with the low pressure reservoir 18. In other embodiments, the time required to substantially equalize the pressure between high pressure reservoir and low pressure reservoir may be less than or greater than six seconds, depending on the size of the precision inlet of the orifice and the pressure difference between the high pressure reservoir and low pressure reservoir. In some embodiments, the high pressure reservoir $\mathbf{20}_A$ includes a pressure sensor to monitor the pressure in the high pressure reservoir $\mathbf{20}_A$, and the delay time after the pressure input ceases is determined from the pressure sensor. The printheads in the system are configured to continue to operate with ink stored in the printhead units, lines, and manifold for the time required to reduce the pressure in the high pressure reservoir and switch the pressure source to the other high pressure reservoir.

Once the pressure between the high pressure reservoir $\mathbf{20}_A$ and the low pressure reservoir 18 is substantially equal, the seal member $\mathbf{70}_A$ is translated downwardly into a seal with outlet opening $\mathbf{36}_A$ as the seal member $\mathbf{70}_B$ is translated upwardly into a seal with inlet opening $\mathbf{32}_B$. The pressure source of pressure input 25 is then activated to pressurize high pressure reservoir $\mathbf{20}_B$. High pressure reservoir $\mathbf{20}_B$ begins supplying ink to the printheads through outlet opening $\mathbf{36}_B$ and outlet channel $\mathbf{37}_B$. High pressure reservoir $\mathbf{20}_A$ is fluidly connected to low pressure reservoir 18 through inlet opening $\mathbf{32}_A$ and begins filling with molten ink.

Because the pressure in the low pressure reservoir 18 and the high pressure reservoir $\mathbf{20}_A$ are substantially equal when the sealing member $\mathbf{70}_A$ switches from sealing the inlet opening $\mathbf{32}_A$ to the outlet opening $\mathbf{36}_A$, no pressurized air bubble transfers from the high pressure reservoir $\mathbf{20}_A$ to the low pressure reservoir 18. Therefore, ink inside the low pressure reservoir 18 is less likely to be perturbed and escape through holes and vents in the low pressure reservoir 18. By dropping the high pressure reservoir to atmosphere and then switching the seal actuators, the spray of ink is avoided.

When active, the pressure source(s) of pressure inlets 24, 25 are configured to operate at input pressures sufficient to compensate for the air escaping through the orifice 100, while maintaining the desired ink pressure to the corresponding high pressure reservoir $\mathbf{20}_A$, $\mathbf{20}_B$ and the printheads. In one embodiment, the pressure through the pressure inlet is nine psi (62 kPa) above atmospheric pressure, resulting in ink pressure to the high pressure reservoir of eight psi (55 kPa). The pressure input may vary in other embodiments depending on the size of the orifice and the desired pressure in the high pressure reservoirs.

The coordinated action of the actuator assembly 56 of the ink delivery control mechanism 50, the pressure inputs 24, 25 to the high pressure reservoirs, the heater 15, and the heating element 30 are controlled by a suitable master control system in one embodiment (not shown). For instance, the master control system controls valves that supply pressurized air to the pressure inputs 24, 25. Likewise, the master control system controls valves that alternately vent and pressurize the air inlets 98, 99 for the pressure cylinder 97 in the actuator assembly 56 associated with the high pressure reservoirs $\mathbf{20}_A$, $\mathbf{20}_B$. In some of the embodiments, the master control system is an electronic controller that is integrated into the printing machine and is operable to control other functions of the machine. The electronic controller is programmable to enable changes to the ink level maximum and minimum thresholds, the air pressure provided to the actuator cylinders, any dwell in cylinder pressurization or de-pressurization, or other operating parameters of the ink delivery system.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An ink delivery system in a phase change ink printer comprising:

a housing forming a first ink reservoir, a second ink reservoir, and a third ink reservoir;

a first ink inlet formed in the housing to enable liquid ink to enter the first ink reservoir;

a first ink outlet formed between the first ink reservoir and the second ink reservoir to enable the liquid ink to move from the first ink reservoir to the second ink reservoir;

a second ink outlet formed between the first ink reservoir and the third ink reservoir to enable the liquid ink to move from the first ink reservoir to the third ink reservoir;

a third ink outlet formed in the housing to fluidly couple the second ink reservoir to at least one printhead;

a fourth ink outlet formed in the housing to fluidly couple the third ink reservoir to the at least one printhead;

a first member positioned within the housing and configured to move between a first position and a second position, the first member forming a seal with the third outlet opening to enable liquid ink to enter the second ink reservoir through the first ink outlet in the first position, and the first member forming another seal with the first ink outlet to enable ink to exit the second ink reservoir through the third ink outlet in the second position;

a second member positioned within the housing and configured to move between a third position and a fourth position, the second member forming a seal with the fourth outlet opening to enable liquid ink to enter the third ink reservoir through the second ink outlet in the third position, and the second member forming another seal with the second ink outlet to enable ink to exit the second ink reservoir through the fourth ink outlet in the fourth position;

a first conduit formed through the housing having a fifth inlet configured to receive pressurized air and a fifth outlet in fluid communication with the second ink reservoir to enable pressurization of air in the second ink reservoir when the first member is in the second position;

a second conduit formed through the housing having a sixths inlet configured to receive pressurized air and a sixths outlet in fluid communication with the third ink reservoir to enable pressurization of air in the third ink reservoir when the second member is in the fourth position;

a first orifice formed in the first conduit, the first orifice being configured to enable pressurized air in the second ink reservoir to exit the second ink reservoir through the first conduit when the first member is in the second position; and a second orifice formed in the second conduit, the second orifice being configured to enable pressurized air in the third ink reservoir to exit the third ink reservoir through the second conduit when the second member is in the fourth position.

2. The ink delivery system of claim 1 further comprising:

a mechanical coupling engaging the first member and the second member; and an actuator operatively connected to the mechanical coupling and configured to move the first member and the second member, the actuator and mechanical coupling being configured to simultaneously move the first member and the second member between the first position and the fourth position, respectively, and the second position and the third position, respectively.

3. The ink delivery system of claim 1 wherein at least a portion of the first conduit extends through the first ink reservoir and the first orifice places the first conduit in fluid communication with the first ink reservoir, and wherein at least a portion of the second conduit extends through the first ink reservoir and the second orifice places the second conduit in fluid communication with the first ink reservoir.

4. The ink delivery system of claim 1 further comprising:

a heater positioned in the first ink reservoir, at least a portion of the heater being positioned below a level of the ink held in the first ink reservoir, the heater being configured to generate heat in the first ink reservoir above a predetermined temperature to maintain melted phase change ink in a liquid phase; and the first orifice and the second orifice being positioned within the first ink reservoir to enable pressurized air moving through the first orifice and the second orifice to enter the first ink reservoir at a level that is above the heater and the level of the melted phase change ink in the first ink reservoir.

5. The ink delivery system of claim 1, the first conduit being configured to enable pressurized air to enter the second ink reservoir at a first airflow rate and the first orifice being configured to enable pressurized air to exit the second ink reservoir at a second airflow rate, and the second conduit being configured to enable pressurized air to enter the third ink reservoir at the first airflow rate and the second orifice being configured to enable pressurized air to exit the third ink reservoir at the second airflow rate, the first airflow rate being greater than the second airflow rate.

6. The ink delivery system of claim 5, the first orifice enabling an air pressure of the second ink reservoir to drop below a predetermined threshold within a first predetermined time period in absence of pressurized air being received by the first air conduit, and the second orifice enabling an air pressure of the air in the third ink reservoir to drop below the predetermined threshold within the first predetermined time period in absence of pressurized air being received by the second air conduit.

7. The ink delivery system of claim 6, the at least one printhead being configured to operate for a second predetermined time period in absence of ink being supplied from both the second ink reservoir and the third ink reservoir, the second predetermined time period being longer than the first predetermined time period.

* * * * *